US005795190A

United States Patent [19]

Ono

[11] Patent Number: 5,795,190

[45] **Date of Patent: *Aug. 18, 1998**

[54] CONNECTOR HAVING GROUND PLATE FOR PC CARDS

[75] Inventor: Michitaka Ono, Tokyo, Japan

[73] Assignee: Japan Aviation Electronics Industry Limited, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 673,305

[22] Filed: Jun. 28, 1996

[30] Foreign Application Priority Data

Jun. 30, 1995 [JP] Japan ..... 7-1662671

[51] Int. Cl.[6] ..... H01R 13/648

[52] U.S. Cl. ..... 439/607; 439/541.5; 439/159

[58] Field of Search ..... 439/92, 108, 64, 439/607, 620, 159, 541.5

[56] References Cited

U.S. PATENT DOCUMENTS

| | | | |
|---|---|---|---|
| 5,197,894 | 3/1993 | Knike | 439/159 |
| 5,308,251 | 5/1994 | Kaufman et al. | 439/108 |
| 5,324,204 | 6/1994 | Lwee | 439/64 |
| 5,389,001 | 2/1995 | Broschard et al. | 439/64 |
| 5,401,176 | 3/1995 | Lwee | 439/64 |
| 5,478,260 | 12/1995 | Kaufman et al. | 439/108 |

FOREIGN PATENT DOCUMENTS

| | | |
|---|---|---|
| 7-22482 | 4/1995 | Japan . |
| 7-244710 | 9/1995 | Japan . |

*Primary Examiner*—Neil Abrams
*Assistant Examiner*—T. C. Patel
*Attorney, Agent, or Firm*—Laff, Whitesel, Conte & Saret, Ltd.

[57] ABSTRACT

In a PC card connector which comprises a connector housing having a receiving space for receiving the PC card and holding a plurality of contact elements disposed in the receiving space for mating with a plurality of contacts of the PC card received in the receiving space, and an ejecting mechanism mounted on the connector housing for ejecting the PC card from the connector, the ejecting mechanism having an ejecting plate slidably mounted on an outer surface of the connector housing so as to engage an edge of the PC card and push out the PC card, a ground plate is fixed onto the connector housing and disposed between the ejecting plate and the outer surface of the connector housing. The ground plate has elastic tabs which are for engaging with ground pads on the PC card and fixing portions for fixing the ground plate onto the connector housing. The fixing portion is also used for connection with a ground pattern on a circuit board on which the connector is mounted in actual use.

7 Claims, 6 Drawing Sheets

CONNECTOR HAVING GROUND PLATE FOR PC CARDS

BACKGROUND OF THE INVENTION

This invention relates to an electrical connector for use in electrical connection with an article having a plurality of contacts such as a memory cards a hard disk drive package or the like and, in particular, to a ground structure of such an electrical connector.

The memory cards and the hard disk drive packages are advantageous because they are detachably mounted in external electronic apparatus such as computer devices, personal computers, laptop computers, notebook type computers.

The external electronic apparatus includes electrical connectors for selectively mounting connecting the memory cards and/or the hard disk drive packages.

Hereinafter, description of the invention will exemplarily be made as regards an electrical connector assembled in a personal computer for selectively and electrically connecting a PC (Personal Computer) card, as a type of memory cards, with an electronic circuit in the personal computer.

A known electrical connector of the type described above comprises a connector housing of an insulator and a receiving space for receiving the PC card, a plurality of mating contact elements disposed in said receiving space for making an electric contact with the contact elements of the PC card received in the receiving space. The connector is usually provided with an ejection mechanism for separating connection between the PC card and the electrical connector to thereby allow the card to be withdrawn out of the personal computer The eject mechanism comprises an electing plate slidably mounted on the connector housing for pushing the PC card away from the connector housing by manual operation of a push button connected with the ejecting plate through a link mechanism with at least one lever.

Various electrical connectors of the type described are disclosed in, for example, U.S. Pat. Nos. 5,197,894, 5,401,176, and 5,324,204, JP-A-7 244710, JP-U-7 22482, and others.

A usual PC card has sixty-four signal contact elements and four ground contact elements. Those contact elements are arranged in two parallel rows, each row comprising twelve signal contact elements and two ground contact elements disposed adjacent the opposite ones of the twelve signal contact elements. The mating contact elements of the electrical connector are also arranged in the corresponding two rows in the similar manner.

However, the four ground contact elements are too limited and insufficient to suppress noise caused on the signal contact elements, particularly, in use of high frequency signal, for example, of 33 MHz. On the other hand, since the PC card is standardized, It is impossible to increase the number of contact elements for ground contacts increased.

SUMMARY OP THE INVENTION

It is therefore an object of this invention to provide an electrical connector for a memory card such as the PC card and a hard disk drive package which has grounding means for providing an increased ground area without substantial Increase of the connector size.

It is another object of this invention to provide an electrical connector with a simple and inexpensive structure.

According to this invention, an electrical connector for use in electrical connection with an article having a plurality of contact and at least one ground pad is provided. The connector comprises: a connector housing of an insulator material having a receiving space for receiving the article and a mounting surface; a contact array of a plurality of mating contact elements fixed to the connector housing and disposed in the receiving spaces to be brought into contact with the contact elements of the article received in the receiving space so that the electrical connection is established between the electrical connector and the article; an ejecting plate slidably mounted on the mounting surface of the connector housing for engaging the article received in the receiving space to push out the article from the receiving space so as to disconnect the article from the electrical connector; and a ground plate of an electroconductive plate disposed between the ejecting plate and the mounting surface of the connector housing and fixedly mounted on the mounting surface, the ground plate having at least one engaging element for engaging with the at least one ground pad of the article received in the receiving space.

Figure 12:
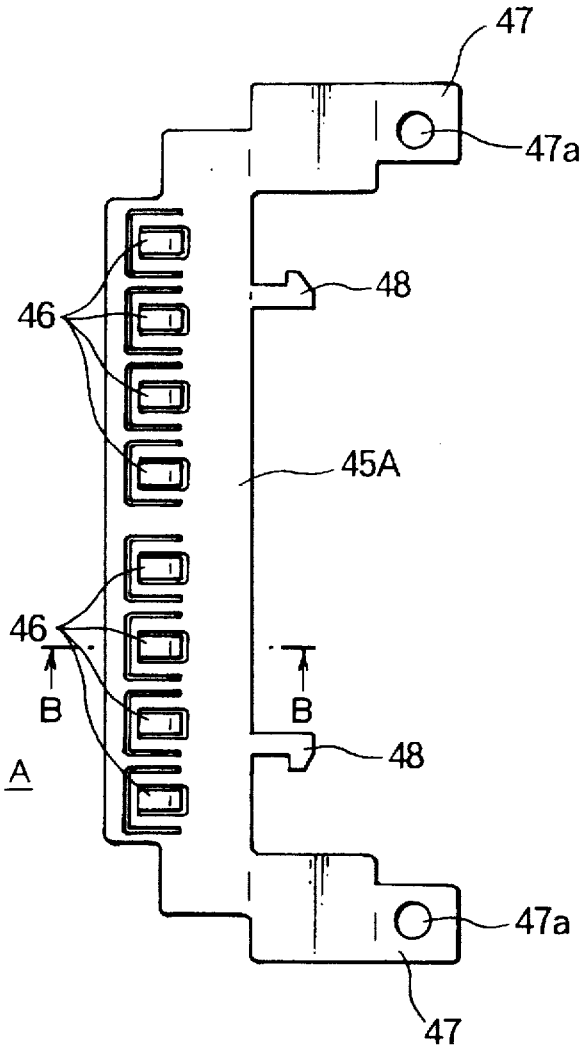
FIG. 12 is a plan view of a rear side ground plate used in the connector of FIG. 4.
Figure 13:
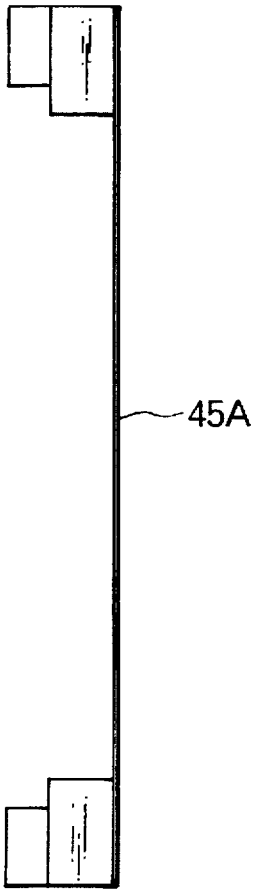
FIG. 13 is a front view of the rear side ground plate of FIG. 12.
Figure 14:
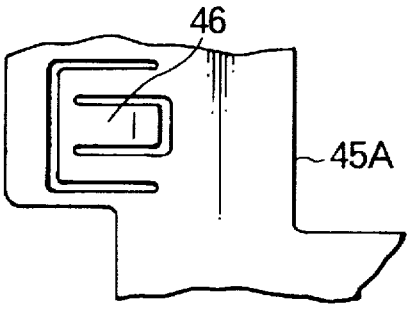
Figure 15:
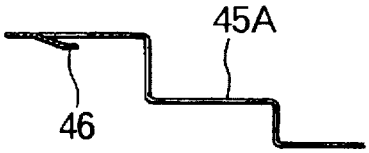

Pig. 14 is an enlarged view of a portion A in FIG. 12;

FIG. 15 is a sectional view taken along a line B—B in FIG. 12; and

Figure 16:
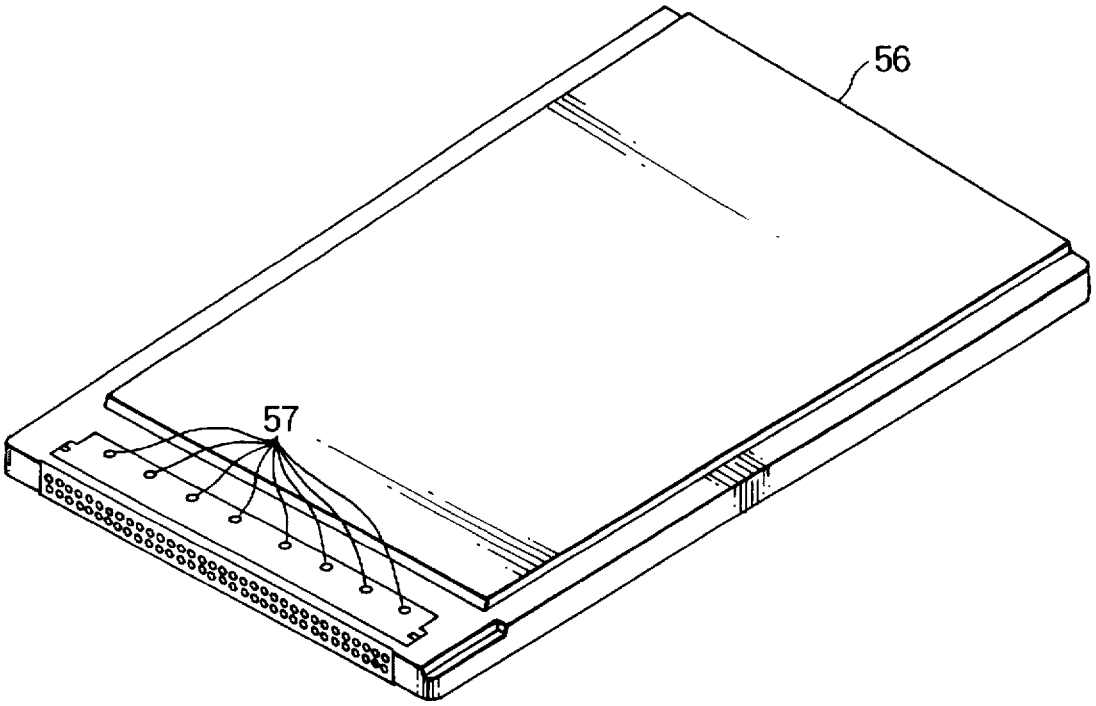

FIG. 16 is a perspective view of a PC card which is inserted into the electrical connector according to the embodiment of this Invention.

DESCRIPTION OF THE PREFERRED EMBODIMENT

Figure 1:
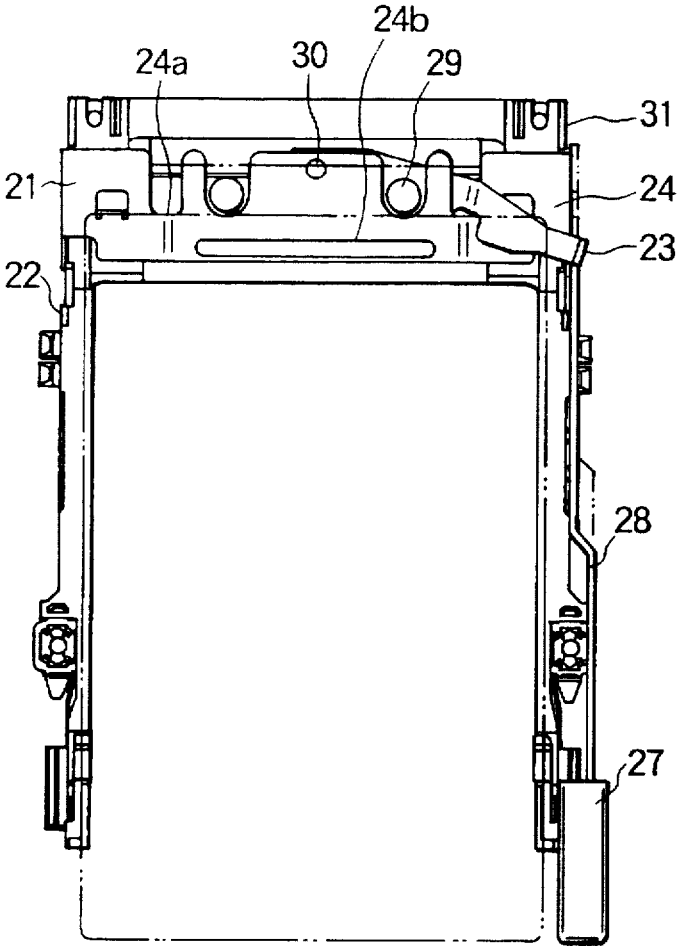
FIG. 1 PRIOR ART
FIG. 1 is a plan view of a conventional electrical connector for PC cards.
Figure 2:
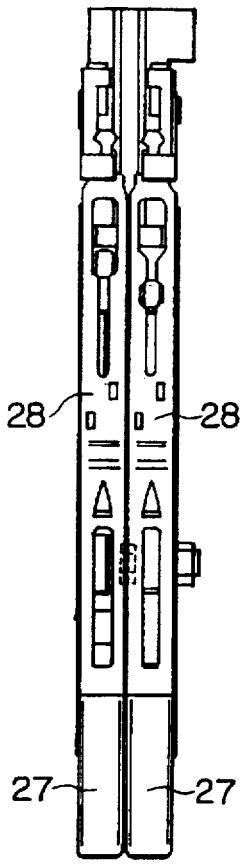
FIG. 2 PRIOR ART
FIG. 2 is a side view of the connector of FIG. 1.
Figure 3:
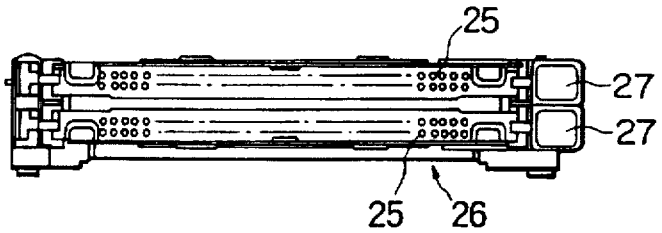
FIG. 3 PRIOR ART
FIG. 3 is a front view of the connector of FIG. 1.

Referring to FIGS. 1, 2, and 3, a conventional electrical connector for PC cards will first be described in order to facilitate an understanding of this invention.

The conventional connector 21 shown comprises a connector housing 22 of an insulator material, a lever 23 pivotally mounted on the housing 22, an ejecting plate 24 slidably mounted on the connector housing 22 and pivotally connected to the lever 23, contact elements 25 (pin contacts or socket contacts) to engage or mate with card contact elements of a PC card, a locator 26 which locates the contact elements 25 exactly, a push button 27 to be manually operated for ejecting the PC card from the connector, and a bar or a connecting rod 28 for connecting the lever 23 and the push button 27. An eject mechanism is composed of the lever 23, the ejecting plate 24, the push button 27 and the bar 28.

The conventional connector shown therein has a structure acceptable of storage of two PC cards at both the front and rear sides thereof, viewing in FIG. 1.

Therefore, the connector housing 22 has two receiving spaces for receiving two PC cards, respectively, in which receiving spaces two sets of contacts elements, each set having two parallel contact rows, are disposed, respectively, as shown by upper two contact rows and lower two contact rows in FIG. 3. The conventional connector shown therein also has two sets of the eject mechanism for the two PC cards, respectively.

Now, description will be made as one of two sets of the eject mechanism accompanied with one of the two receiving spaces of the connector housing 22, for the purpose of simplification of the description.

The ejecting plate 24 is disposed on a main surface of the connector housing and is movably attached to both sides thereof to be slidable along the main surface to the up and down direction in FIG. 1. The ejecting plate 24 has a pair of claws 24*a* which engages with a top edge of the PC card 14 inserted into the receiving space of the connector housing 22. The ejecting plate 24 has a rib 24*b* at the center thereof for the sake of reinforcement thereof.

A lever 23 is rotatably secured at a rotating center 29 onto the connector housing 22. The lever 23 links the ejecting plate 24 with a pivot 30. Therefore, the ejecting plate 24 is moved in the up and down direction by rotation of the lever 23 about the rotating center 29. The connector housing 22 has both side walls 31.

In FIGS. 1, 2, and 3, PC cards 32 is shown by an imaginary line in a state inserted into the connector 21. When the PC card 32 stored in the front side storage space is ejected from the connector housing 22, there needs the following operation. When the push button 27 installed at the front side is pushed to the up direction in FIGS. 1 and 2, the lever 23 is rotated counterclock-wise around the rotating center 29 through the bar 28 connecting the push button 27 and the lever 23. Thereupon, the lever 23 pushes the ejecting plate 24 to the down direction in FIGS. 1 and 2 through the pivot 30. Then, the claws 24*a* of the eject plate 24 push the PC card 32 to the down direction, so that the PC card 32 is ejected from the connector 21 finally.

When the push button 27 installed at the rear side is pushed to the up direction in FIGS. 1 and 2, the PC card 32 arranged at the rear side is ejected from the slot of the connector housing 22 in the same way as described above.

Referring now to FIGS. 4 to 16, the description will proceed to a connector 41 for PC cards according to a preferred embodiment of this invention.

The connector 41 for PC cards according to the preferred embodiment of this invention has a structure acceptable of storage of two PC cards at both the front and rear sides thereof.

The rear side structure of the connector 41 is similar to the front side structure of the same connector.

Figure 4:
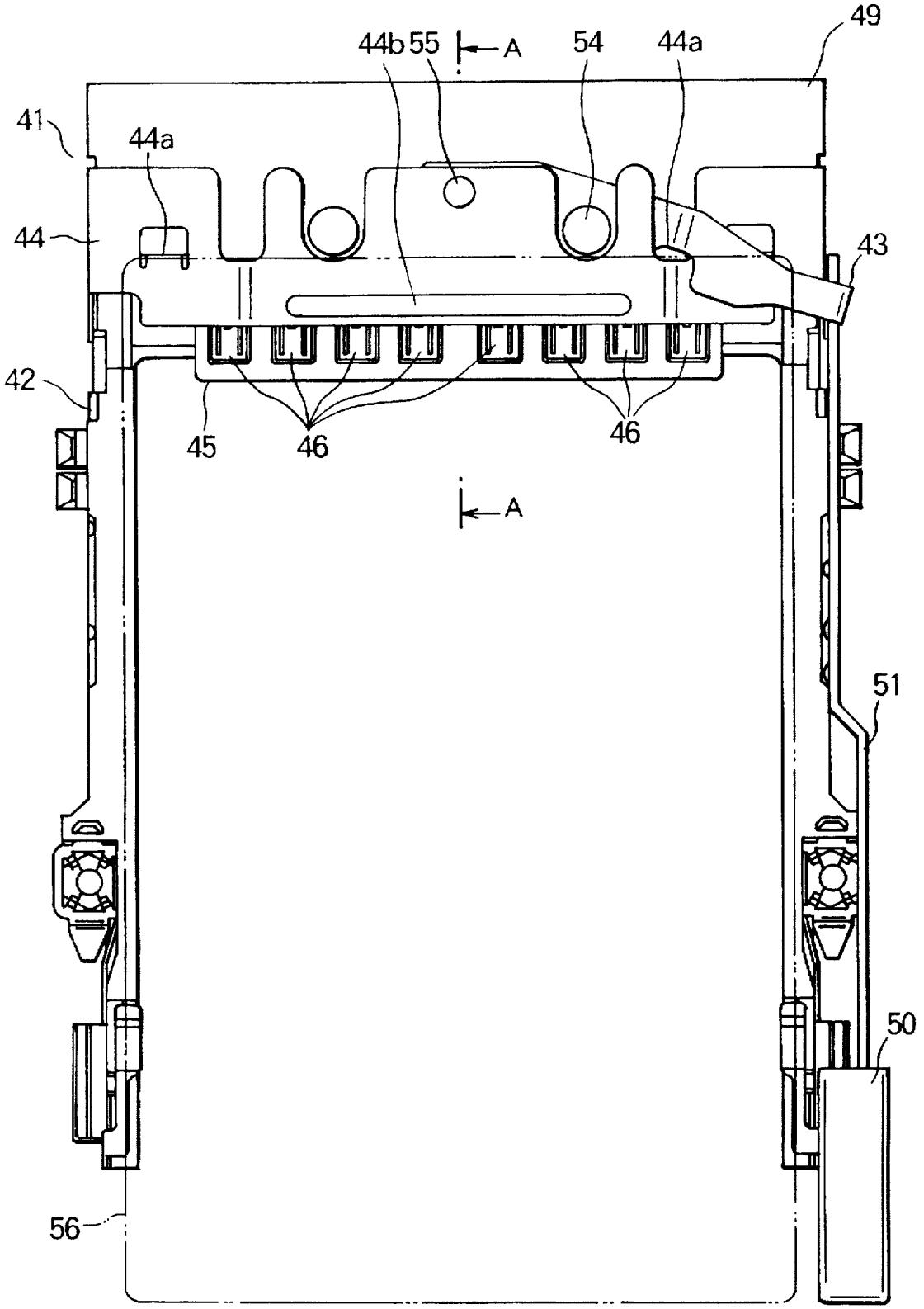
FIG. 4 is a plan view of an electrical connector according to an embodiment of this invention.
Figure 5:
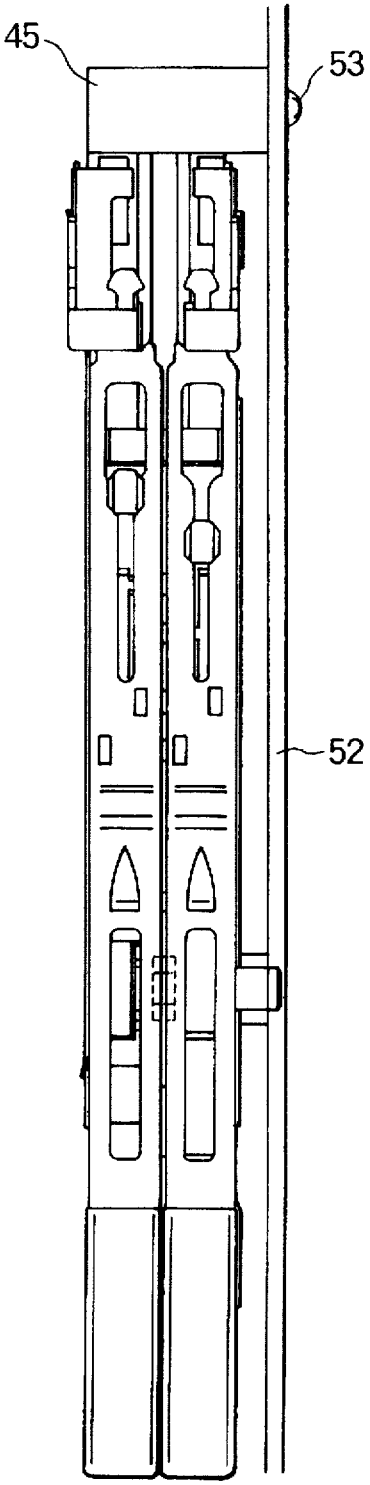
FIG. 5 is a side view of the connector of FIG. 4.
Figure 6:
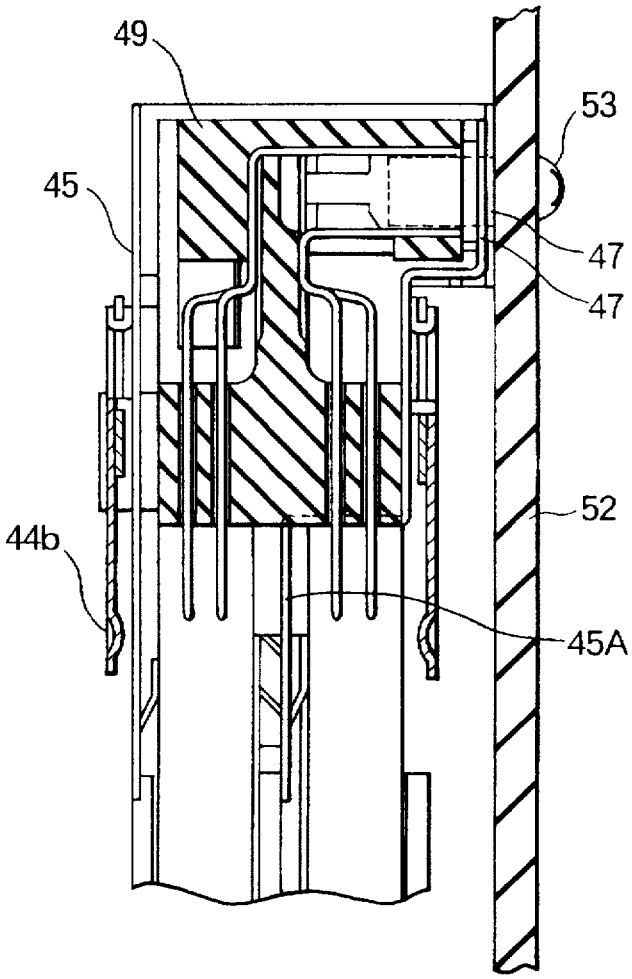
FIG. 6 is an enlarged sectional view of an essential portion in FIG. 5.
Figure 7:
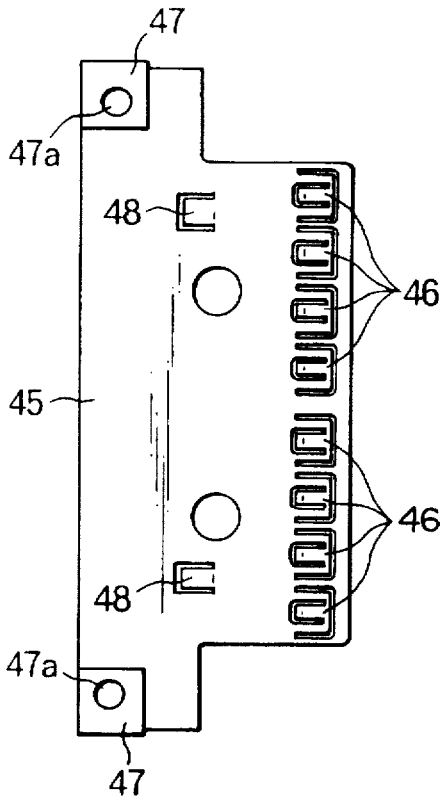
FIG. 7 is a rear view of a front side ground plate used in the connector of FIG. 4.
Figure 8:
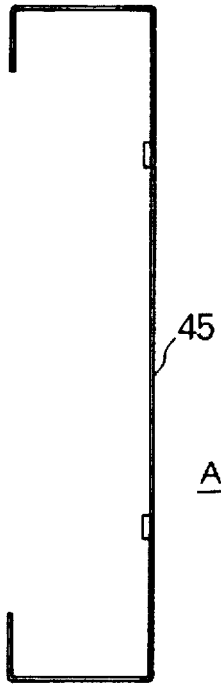
FIG. 8 is a front view of the front side ground plate of FIG. 7.
Figure 9:
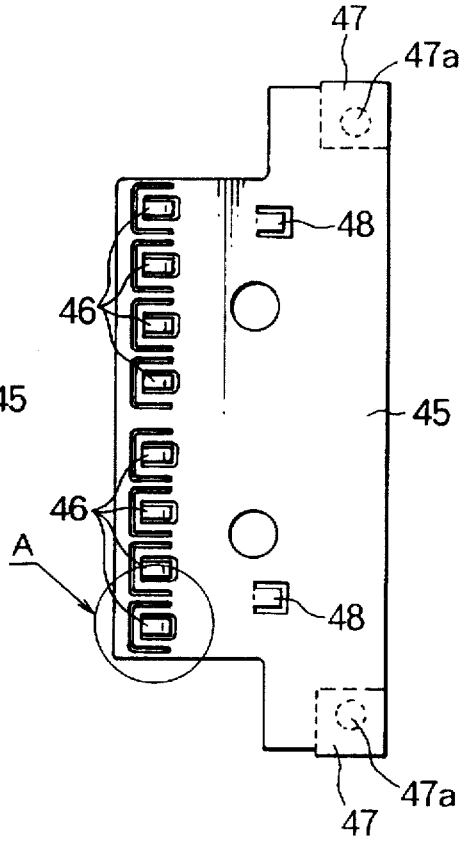
FIG. 9 is a plan view of the front side ground plate of FIG. 7.
Figure 10:
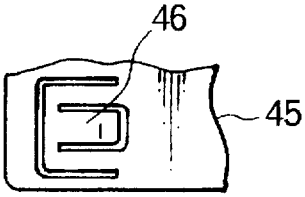
FIG. 10 is an enlarged view of a portion A in FIG. 9.
Figure 11:
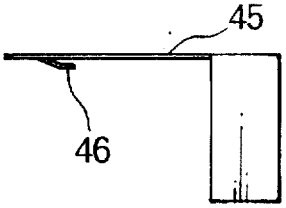
FIG. 11 is a side view of the front side ground plate of FIG. 7.

With respect to one of the front and the rear side structures of the connector, as shown in FIGS. 4, 5, and 6, the connector 41 for PC cards comprises a connector housing 42 of an insulator material, a lever 43 pivotally mounted on the connector housing 42, an ejecting plate 44 slidably mounted on the connector housing 42, and a ground plate 45 having plural engage or contact members 46, a push button 50 to be manually operated for ejecting the PC card from the connector, a bar 51 for connecting the lever 43 and the push button 50.

The connector 41 is used and mounted onto a printed circuit board 52.

The connector housing 42 has two receiving spaces for receiving two PC cards, respectively, in which receiving spaces two sets of contact elements, each set having two parallel contact rows, are disposed, respectively, in the similar manner as shown at 25 in FIG. 3.

With respect to ground plate, two ground plates 45 and 45A are also disposed in the front and the rear side structures for the two PC cards, respectively An eject mechanism is composed of the lever 43, the ejecting plate 44, the push button 50 and the bar 51. The lever is mounted on the connector housing 42 to be rotatable around a shaft 54 formed on the connector housing 42. An end portion of the lever 43 is pivoted at 55 to the ejecting plate 44 and the opposite end portion is connected to the bar 51. Thus, the manual operation of the push button 50 rotates the lever 43 to move the ejecting plate 44 in the up and down direction In FIG. 4. Two sets of the eject mechanism are also provided for the front and rear side structures of the connector 41 for two PC cards inserted therein. One of the two sets of the ejecting mechanism will be described hereinunder, for the purpose of simplification of the description. The ejecting plate 44 is disposed on a main surface of a portion of the connector housing 42 and is movably attached to both sides thereof to be slidable along the main surface to the up and down direction in FIG. 4. The ejecting plate 44 has a pair of claws 44*a* which engages with a top edge of the PC card 56 inserted into the receiving space of the connector housing 42. The ejecting plate 44 has a rib 44*b* at the center thereof for the purpose of the reinforcement thereof. The rib 44*b* prevents the front side ground plate 45 from bending, and ensures touching between the plural contact members 46 of the ground plate 45 and plural ground pads or projections 57 of the PC card 56.

In FIGS. 7 to 15, the plural engagement elements 46 of the front side ground plate 45 and the rear side ground plate 45A are made as tabs each being formed by partially cutting and bending the ground plate. The front side ground plate 45 and the rear side ground plate 45A have a pair of fixing portions 47 having a screw hole 47*a*, respectively. In FIGS. 15, the rear side ground plate 45A has a stairs-shaped structure in a sectional view thereof. The front side and the rear side ground plates 45 and 45A have pairs of hooks 48 which catch into the facing outer surface of the connector housing 42, so that the ground plates 45 and 45A do not float up from the outer surface.

The front side ground plate 45 covers the outside of the connector housing 42. The front side ground plate 45 and the rear side ground plate 45A are arranged between the eject plates 44 and the opposite surfaces of a housing portion 49 of the connector housing 42, respectively, as shown In FIG. 6.

In use, the connector 41 is mounted on the circuit board 52, which has, thereon, electroconductive patterns (not shown) to be connected to the plurality of signal contacts 25 of the electrical connector and a ground pattern. The connector housing 42 is provided with a mounting surface which is brought into touch with the ground pattern on the circuit board 52.

The ground plates 45 and 45A have extensions extending along the connector housing 42 to have the fixing portions 47 on the mounting surface. The screws 53 are used to fix the connector 41 onto the circuit board 52 by screwing the screws 53 into the connector housing 42 through the circuit board 52 and the fixing portions 47, as shown in FIG. 6.

When PC cards 56 shown in FIG. 16 are inserted into the receiving spaces of the connector housing 42, the plural ground pads 57 of the PC cards 56 elastically touch the plural tabs 46 of the front side and rear side ground plates 45 and 45A, respectively.

Thus, the ground pads 57 of each PC card 56 can be electrically connected with the ground pattern of the circuit board 52 through the tabs 46, the extensions and fixing portions 47 of the ground plates 45, 45A, as shown in FIG. 6.

The ejecting operation of PC cards from the connector 41 is similar as in the conventional connector.

An electrical connector according to one embodiment of the present invention has been described which has two front side and rear side structures for storing two PC cards, respectively. However, the connector can be modified to store a single PC card or to store more than two PC cards.

Although, the present invention has been described with reference to connectors for PC card, the present invention can be applied to connectors for, generally, memory cards, hard disk drive packages and others.

What is claimed is:

1. An electrical connector for electrical connections with an article having a substantially rectangular surface with a plurality of contacts and ground pads thereon and having a side surface with a plurality of contact elements thereon, said connector comprising:

a connector housing made of an insulator material having a receiving space for receiving said article and having a mounting surface;

a contact array of a plurality of mating contact elements fixed to said connector housing and disposed in said receiving spaces to be brought into contact with said contact elements of said article received in said receiving space so that the electrical connection is established between said electrical connector and said article;

an ejecting plate slidably mounted on said mounting surface of said connector housing for engaging said article received in said receiving space in order to push out said article from said receiving space so as to disconnect said article from said electrical connector; and a ground plate of an electroconductive plate disposed between said ejecting plate and said mounting surface of said connector housing and fixedly mounted on said mounting surface over and covering the electrical connection portion between said mating contact elements of said connector housing and said contact elements of said article, said ground plate having a plate surface opposite to said rectangular surface of said article, and having a plurality of engaging elements formed on said plate surface thereof for engaging with said a plurality of ground pads of said article received in said receiving space.

2. An electrical connector as claimed in claim 1, wherein said ground plate having a pair of hooks caught by said connector housing to be fixed to said connector housing.

3. An electrical connector as claimed in claim 1, said article having a plurality of ground pads exposed on one outer surface thereof, wherein said ground plate has a plurality of tabs elastically projecting thereon, each of said tabs, as said engaging elements, being in elastic contact with each of said ground pads of said article received in said receiving space of said connector housing.

4. An electrical connector as claimed in claim 3, wherein each of said tabs is one which is formed by partially cutting and bending the ground plate.

5. An electrical connector as claimed in claim 1, wherein said ground plate having a fixing portion which is fixed to said connector housing by means of screws.

6. An electrical connector as claimed in claim 5, said electrical connector being mounted on a circuit board having, thereon, electroconductive patterns to be connected to said plurality of mating contacts of said electrical connector and a ground pattern, wherein said connector housing is provided with a mounting surface which is brought into touch with said ground pattern on said circuit board, said ground plate having an extension extending along said connector housing to have said fixing portion on said mounting surface, said screw being one using to fix said connector onto said circuit board by screwing into said connector housing through said circuit board and said fixing portion.

7. An electrical connector as claimed in claim 1, wherein said article is a PC card.

* * * * *

UNITED STATES PATENT AND TRADEMARK OFFICE

CERTIFICATE OF CORRECTION

PATENT NO. : 5,795,190
DATED : August 18, 1998
INVENTOR(S) : Michitaka Ono

It is certified that error appears in the above-identified patent and that said Letters Patent is hereby corrected as shown below:

Column 1, Line 54, delete "It" and insert --it--
Column 1, Line 62, delete "Increase" and insert --increase--
Column 2, Line 47, delete "Pig" and insert --FIG.--
Column 2, Line 52, delete "Invention" and insert --invention-
Column 3, Line 25, delete "14" which has been omitted from FIG. 1 but not the specification
Column 3, Line 36, "32" used to represent the PC Card; The Amendment of April 22, 1997 changed "32" to "14" (in col. 3, ln. 25); "14" omitted from FIG. 1 when Formal Drawings submitted on May 22, 1998.
Column 3, Line 38, "32" - same as above
Column 3, Line 47, "32" - same as above
Column 3, Line 50, "32" - same as above
Column 4, Line 24, delete "In" and insert --in-
Column 4, Line 37, delete "The" and insert --the--
Column 4, Line 38, delete the period "." after "bending"
Column 4, Line 46, delete "FIGS." and insert --FIG.--

Signed and Sealed this

Second Day of February, 1999

*Attest:*

*Attesting Officer*

*Acting Commissioner of Patents and Trademarks*